United States Patent [19]

Nakamura

[11] Patent Number: 4,919,100

[45] Date of Patent: Apr. 24, 1990

[54] FUEL INJECTION CONTROL SYSTEM FOR AN AUTOMOTIVE ENGINE

[75] Inventor: Mitsuo Nakamura, Tokyo, Japan

[73] Assignee: Fuji Jukogyo Kabushiki Kaisha, Tokyo, Japan

[21] Appl. No.: 344,270

[22] Filed: Apr. 27, 1989

[30] Foreign Application Priority Data

Apr. 30, 1988 [JP] Japan ..... 63-109501

[51] Int. Cl.[5] ..... F02D 41/10; F02D 41/12

[52] U.S. Cl. ..... 123/492; 123/488; 123/493

[58] Field of Search ..... 123/492, 493, 494, 488

[56] References Cited

U.S. PATENT DOCUMENTS

| | | | |
|---|---|---|---|
| 4,010,717 | 3/1977 | Taplin | 123/492 |
| 4,191,137 | 3/1980 | Williams et al. | 123/492 |
| 4,359,993 | 11/1982 | Carlson | 123/492 |
| 4,712,529 | 12/1987 | Terasaka et al. | 123/492 |

FOREIGN PATENT DOCUMENTS 60-3448 1/1985 Japan .

*Primary Examiner*—Andrew M. Dolinar
*Attorney, Agent, or Firm*—Martin A. Farber

[57] ABSTRACT

A basic injection quantity is determined by engine speed and intake passage pressure. The pressure is estimated from engine speed and throttle position, and changing rate of the estimated pressure is calculated. A correcting quantity is obtained from the changing rate of the estimated pressure. The basic injection quantity is corrected with the correcting quantity.

4 Claims, 9 Drawing Sheets

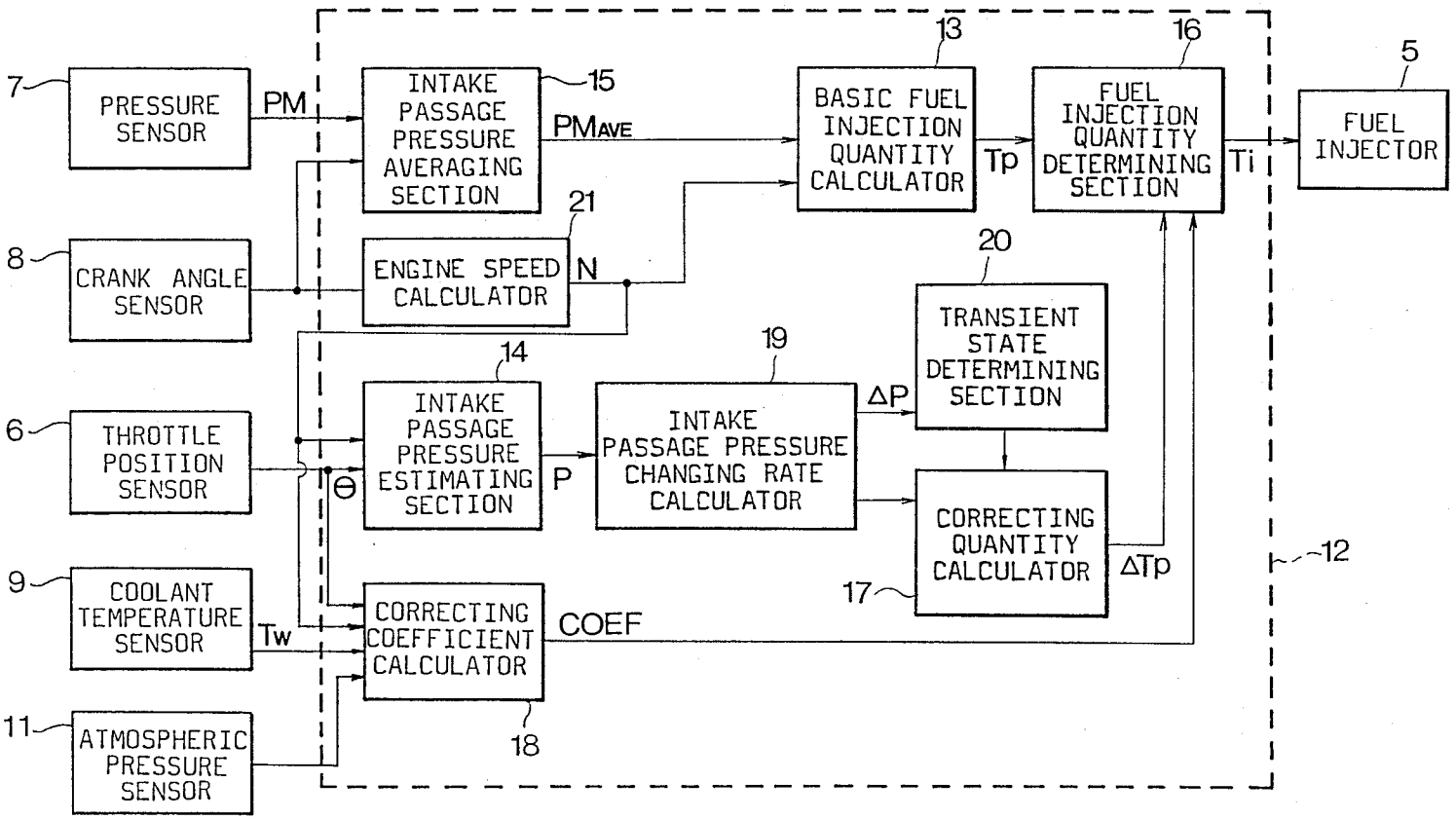
FIG. 3
FUEL INJECTOR
5
12
FUEL INJECTION QUANTITY DETERMINING SECTION
16
Ti
ΔTp
TRANSIENT STATE DETERMINING SECTION
20
CORRECTING QUANTITY CALCULATOR
17
Tp
BASIC FUEL INJECTION QUANTITY CALCULATOR
13
ΔP
INTAKE PASSAGE PRESSURE CHANGING RATE CALCULATOR
19
COEF
PMAVE
15
21
N
P
INTAKE PASSAGE PRESSURE AVERAGING SECTION
ENGINE SPEED CALCULATOR
14
INTAKE PASSAGE PRESSURE ESTIMATING SECTION
CORRECTING COEFFICIENT CALCULATOR
18
θ
PM
Tw
PRESSURE SENSOR
CRANK ANGLE SENSOR
THROTTLE POSITION SENSOR
COOLANT TEMPERATURE SENSOR
ATMOSPHERIC PRESSURE SENSOR
7
8
6
9
11

FUEL INJECTION CONTROL SYSTEM FOR AN AUTOMOTIVE ENGINE

BACKGROUND OF THE INVENTION

The present invention relates to a system for controlling the fuel injection in the automotive engine in accordance with engine operating conditions.

In a known fuel injection system, basic fuel injection quantity Tp is calculated in dependency on absolute pressure in an intake passage of the engine and engine speed. A pressure sensor is provided downstream of a throttle valve in the engine for detecting the absolute pressure in the intake passage. The engine speed is detected by a crank angle sensor. In accordance with output signals from these sensors, the basic fuel injection quantity Tp is determined. Actual fuel injection quantity Ti is obtained by correcting the basic fuel injection quantity Tp in accordance with engine operating conditions such as coolant temperature and throttle opening degree.

However, the absolute pressure in the intake passage oscillates because of pulsation of intake air. Consequently, the basic fuel injection quantity Tp varies in accordance with the pulsation. Thus, the operation of the engine becomes unstable, particularly at low engine speed.

Japanese Patent Application Laid-Open 60-3448 discloses a fuel injection control system In the system, pressure in the intake passage is sampled at a first timing synchronizing with rotation of a crankshaft of an engine, and further sampled at a second timing having a shorter period than the first timing. The sampled pressures are averaged to obtain a first average pressure and a second average pressure. The first and second mean pressures are selected in accordance with engine operating conditions. In dependency on the engine speed and the selected pressure value, the basic fuel injection quantity Tp is calculated.

However, at a transient state of the operation of the engine, the average pressure $PM_{AVE}$ based on the pressure PM is produced with a delay with respect to the requirement of the engine operation, as shown in FIG. 7. As a result, fuel injection quantity deviates from a necessary quantity.

SUMMARY OF THE INVENTION

The object of the present invention is to provide a fuel injection control system which may provide proper fuel injection quantity without deviation from a necessary quantity.

In the system of the present invention, the pressure in the intake passage is estimated from engine speed and throttle position. Changing rate of the estimated pressure is calculated for producing a correcting value. A basic fuel injection quantity is corrected with the correcting value.

According to the present invention, there is provided a system for controlling fuel injection of an engine for a motor vehicle having an intake passage, a throttle valve provided in the intake passage, and a fuel injector for injecting fuel by a quantity determined by the system.

The system comprises an engine speed sensor producing an engine speed signal dependent on speed of the engine, a throttle position sensor producing a throttle position signal dependent on opening degree of the throttle valve, a pressure sensor producing a pressure signal dependent on pressure in the intake passage, first calculator means responsive to the engine speed signal and the pressure signal for producing a basic fuel injection quantity signal, estimating means responsive to the engine speed signal and the throttle position signal for estimating pressure in the intake passage and for producing an estimated pressure signal, second calculator means for calculating a changing rate of the estimated pressure signal, means responsive to the changing rate of the estimated pressure signal for producing a correcting signal, corrector means for correcting the basic fuel injection quantity signal with the correcting signal, thereby determining the quantity of fuel to be injected.

The other objects and features of this invention will become understood from the following description with reference to the accompanying drawings.

BRIEF DESCRIPTION OF DRAWINGS

FIG. 3 is a block diagram showing a fuel injection control system of the control unit;

DETAILED DESCRIPTION OF THE PREFERRED EMBODIMENT

Figure 1:
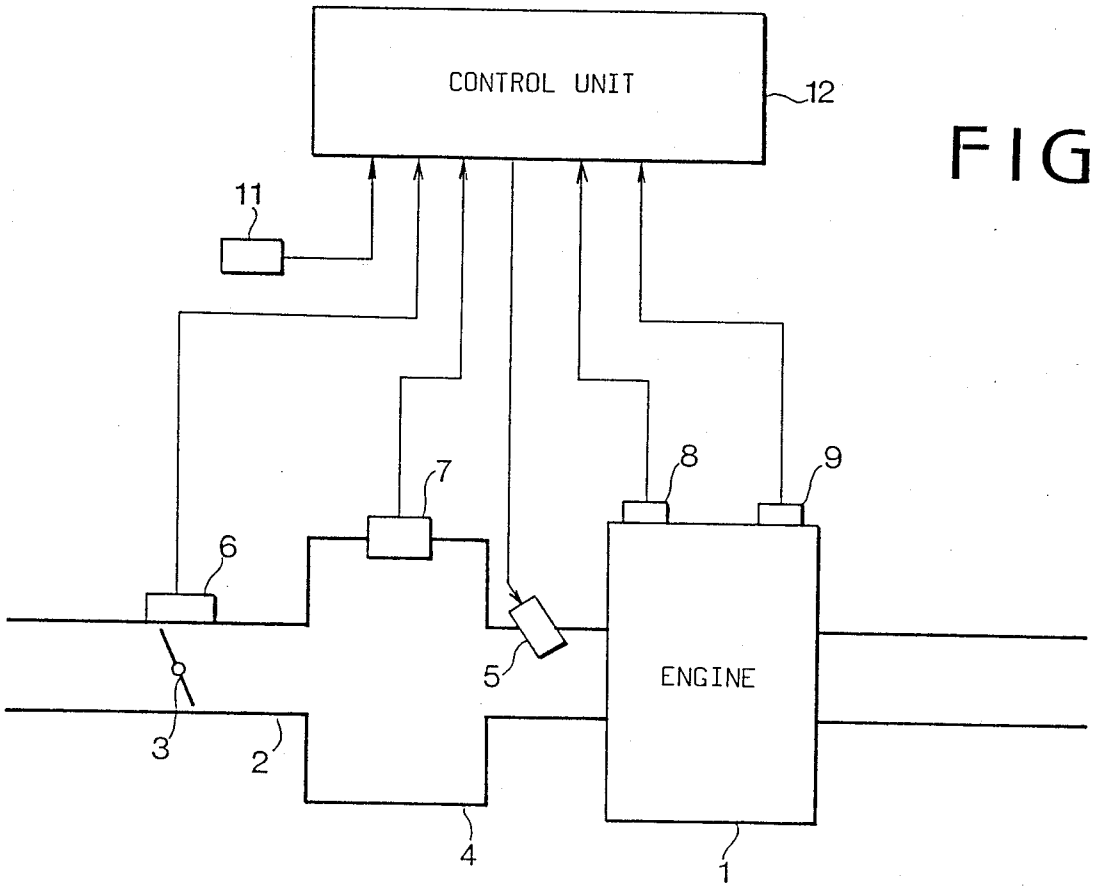
FIG. 1 is a schematic diagram showing a system according to the present invention.

Referring to FIG. 1, in an intake passage 2 of an engine 1, a collector chamber 4 is provided downstream of a throttle valve 3 so as to absorb pulsation of intake air. Multiple fuel injectors 5 are provided in the intake passage 2 at adjacent positions of intake valve so as to supply fuel to each cylinder of the engine 1. A throttle position sensor 6 is provided on the throttle valve 3. A pressure sensor 7 is provided in the collector chamber 4 for detecting the pressure in the intake passage. A crank angle sensor 8 and a coolant temperature sensor 9 are provided on the engine 1. An atmospheric pressure sensor 11 is provided for detecting atmospheric pressure. Output signals of the sensors for detecting respective conditions are applied to a control unit 12 comprising a microcomputer to operate the fuel injectors 5.

Figure 2:
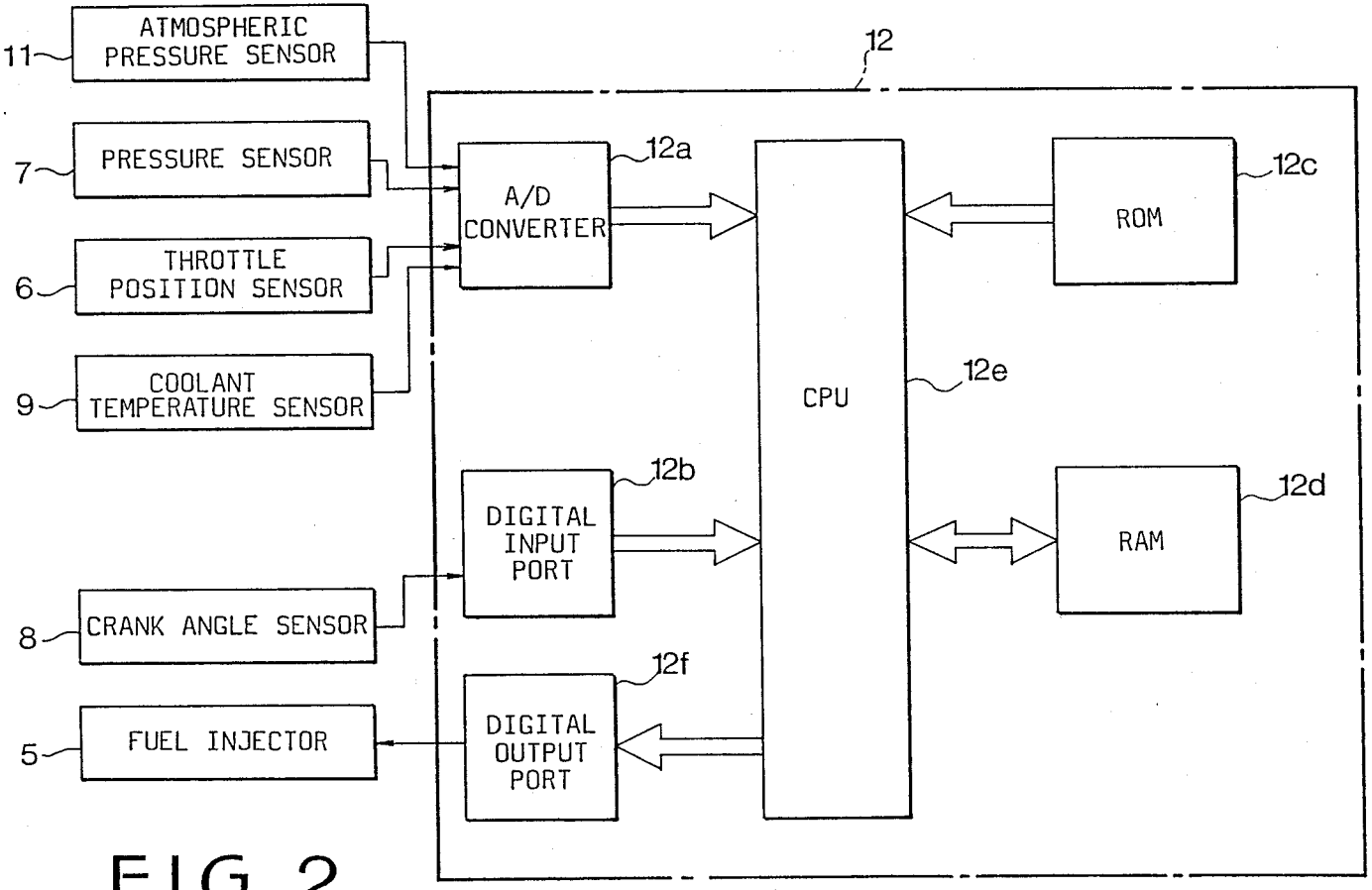
FIG. 2 is a block diagram showing a control unit of the present invention.

Referring to FIG. 2, the control unit 12 comprises an A/D converter 12*a* supplied with signals from the pressure sensor 7, throttle position sensor 6, coolant temperature sensor 9 and atmospheric pressure sensor 11. A digital input port 12*b* is supplied with signals from the crank angle sensor 8. Output signals from the A/D converter 12*a* and input pot 12*b* are applied to a central processor unit (CPU) 12*e*. The CPU 12*e* operates to proceed these signals in accordance with data and programs stored in a read only memory (ROM) 12*c* and a random access memory (RAM) 12*d* and produces a control signal which is applied to a digital output port 12*f* for driving fuel injectors 5.

Referring to FIG. 3 showing a fuel injection control system, engine speed N is calculated in an engine speed calculator 21 in dependency on a crank angle signal from the crank angle sensor 8, synchronizing with the engine speed. The engine speed N is applied to a basic fuel injection quantity (pulse width) calculator 13 and an intake passage pressure estimating section 14. A top dead center signal derived from the crank angle signal is applied to an intake passage pressure averaging section 15 to which an intake passage pressure PM from the sensor 7 is applied.

In the intake passage pressure averaging section 15, the intake passage pressure PM is sampled at a short sampling cycle and the sampled pressures are averaged at every cycle dependent on the top dead center signal through a weighted mean method for obtaining an average pressure $PM_{AVE}$ by the following equation.

$$PM_{AVE}(t)=k\times PM_{AVE}(t-1)+(1-k)PM(t)$$

where k is weight. Accordingly, influence of oscillation of the absolute pressure in the intake passage can be eliminated.

The average pressure $PM_{AVE}$ is applied to the basic fuel injection quantity calculator 13. The calculator 13 calculates a basic fuel injection quantity Tp based on the average pressure $PM_{AVE}$ and the engine speed N, using data derived from the table in the ROM 12*c*. The basic injection quantity Tp is applied to a fuel injection quantity determining section 16.

Figure 4A:
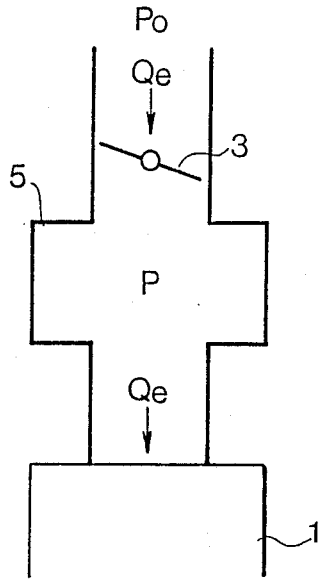
FIGS. 4*a* and 4*b* are schematic views of an intake system.
Figure 4B:
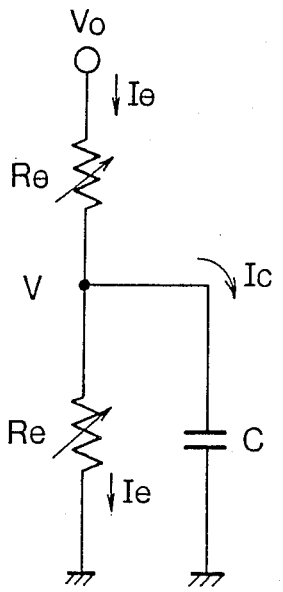

The intake passage pressure estimating section 14 estimates an estimation pressure P in accordance with the throttle opening degree $\theta$ obtained from the throttle position sensor 6 and the engine speed N with a predetermined model equation The model equation is obtained from an equivalent circuit shown in FIG. 4*b* for the intake system shown in FIG. 4*a*.

Figure 8:
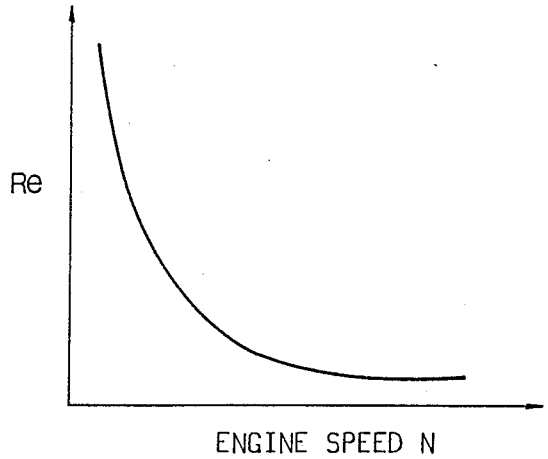
FIG. 8 is a graphs showing a relationships between resistance Re and the engine speed.
Figure 9:
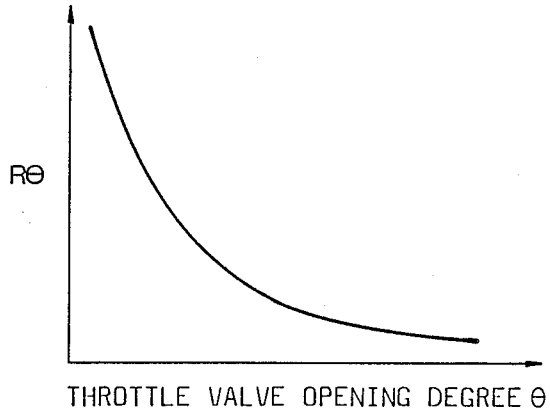
FIG. 9 is a graph showing a relationship between resistance $R_\theta$ and the throttle opening degree.

The intake system schematically illustrated in FIG. 4*a* approximately equals to the electric circuit of FIG. 4*b*. Namely, Po represents a pressure at upstream of the throttle valve 3 and corresponds to the voltage Vo in FIG. 4*b*. The pressure P in the intake passage 2 at downstream of the throttle valve 3 and chamber 5 corresponds to the voltage V and quantity $Q_\theta$ corresponds to current $I_\theta$ in FIG. 4*b*. Reference Qe represents actual quantity of air inducted in the cylinder of the engine 1 and corresponds to current Ie. Current Ic represents a delay of response at the transient state of the engine. Resistances Re and $R_\theta$ and a capacitance C are factors for the delay of response. As shown in FIGS. 8 and 9, the resistance Re can be obtained as a function of the engine speed N and resistance $R_\theta$ can be obtained as a function of the opening degree $\theta$ of the throttle valve 3. The model equation is expressed as follows.

$$C\times dV/dt=(Vo-V)/R_\theta-V/Re$$

$$V=\{Re/(R_\theta+Re)\}\times Vo\times(1-e^{-t/\tau})$$

$$\tau=C\times R_\theta\times Re/(R_\theta+Re)$$

Thus, the estimated pressure P is expressed as $$P=\{Re/(R_\theta+Re)\}\times Po\times(1-e^{-t/\tau})$$

In other words, it will be seen that the intake passage pressure P is estimated in accordance with engine speed N and throttle opening degree $\theta$.

The estimated pressure P from the section 14 is applied to an intake passage pressure changing rate calculator 19 where the pressure P is differentiated to obtain a changing rate $\Delta P$ in accordance with the following equation.

$$\Delta P=\{P(t)-P9t-\Delta t)\}/\Delta t$$

Figure 10:
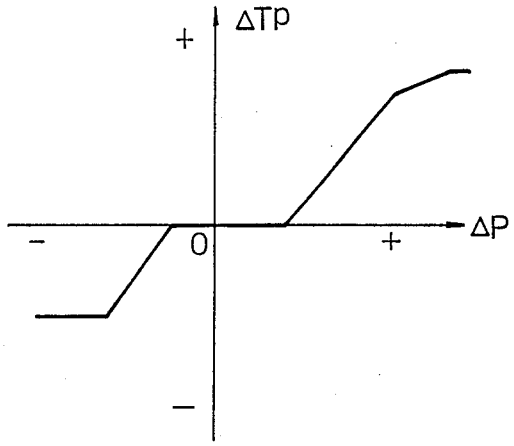
FIG. 10 is a graph showing a relationship between changing rate of estimated pressure and correcting quantity.
Figure 11:
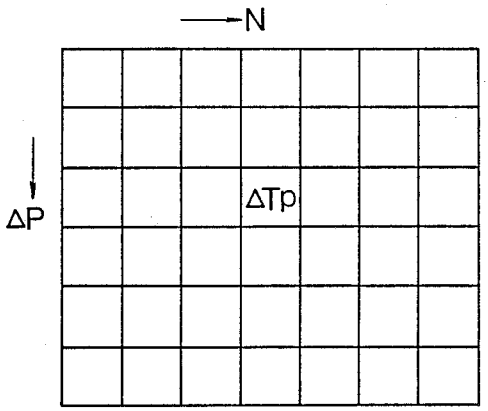
FIG. 11 is a table storing correcting quantities.

The changing rate $\Delta P$ is fed to a transient state determining section 20 where it is determined whether the engine is accelerating or decelerating from a steady state by comparing the changing rate $\Delta P$ with a predetermined reference value $\Delta Pref$. When $\Delta P<\Delta Pref$, it is determined that the engine is in a transient state. An output signal of the section 20 and the changing rate $\Delta P$ are fed to a correcting quantity calculator 17 where a correcting quantity $\Delta Tp$ is calculated. The correcting quantity $\Delta Tp$ may be obtained in dependency on the changing rate $\Delta P$ as shown in a graph of FIG. 10, or derived from a three-dimensional table having the changing rate $\Delta P$ and the engine speed N as parameters as shown in FIG. 11. The correcting quantity $\Delta Tp$ is applied to the fuel injection quantity determining section 16.

Coolant temperature TW obtained from the sensor 9, atmospheric pressure from the sensor 11, and other signals $\theta$ and N from sensors 6 and 8 are applied to a correcting coefficient calculator 18 where a miscellaneous correction coefficient COEF is calculated. The coefficient COEF is applied to the fuel injection quantity determining section 16 in which an injection quantity Ti is calculated through an equation $Ti=Tp\cdot\Delta Tp\cdot COEF$. An output signal representing the quantity Ti is applied to the injectors 5 as the fuel injection pulse width.

Figure 5:
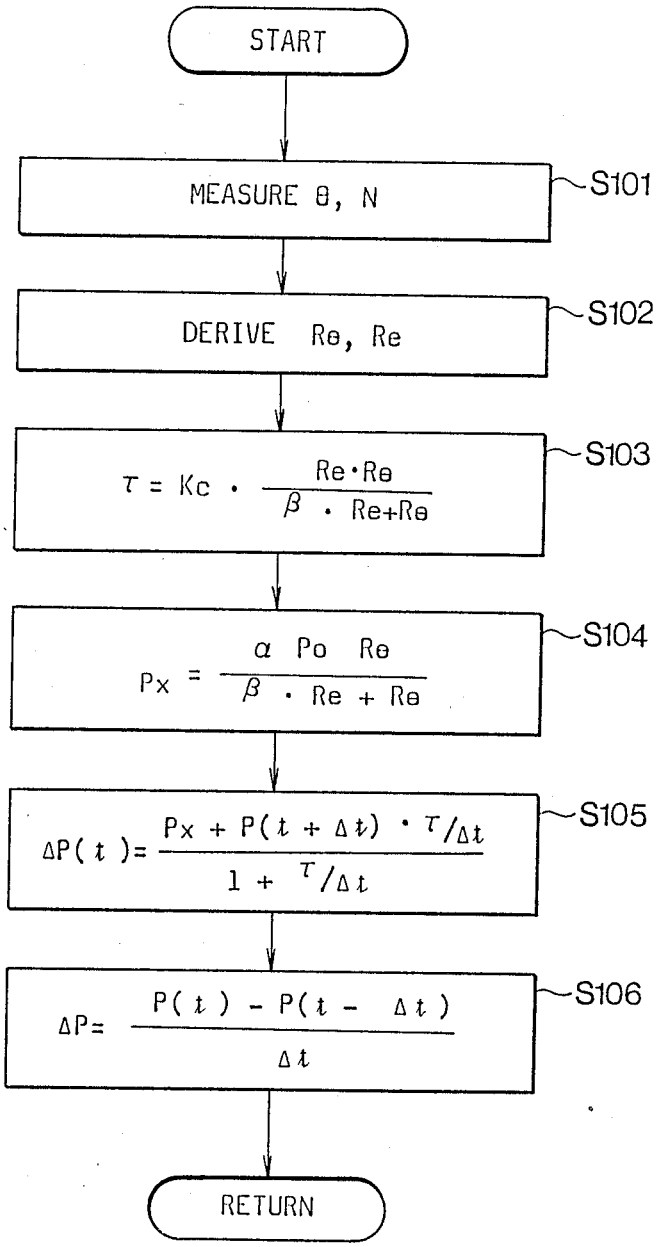
FIG. 5 is a flowchart showing a calculation routine for the fuel injection control.

The calculation for determining the intake passage pressure changing rate $\Delta P$ in the operation of the system is described with reference to the flowchart shown in FIG. 5. At a step S101, the throttle valve opening degree $\theta$ is obtained from the output signal of throttle position sensor 6, and engine speed N is calculated based on the output signal of crank angle sensor 8. At a step S102, the resistances $R_\theta$ and Re are derived from lookup tables in accordance with throttle opening degree $\theta$ and the engine speed N. At a step S103, the time constant $\tau$ for the response delay is calculated. At steps S104 and S105, calculations are performed and the estimated pressure P is obtained. In the equations described in the flowchart, Kc, $\alpha$, and $\beta$ are constants, respectively. At a step S106, the changing rate $\Delta P$ of the estimated pressure P is calculated.

Figure 6:
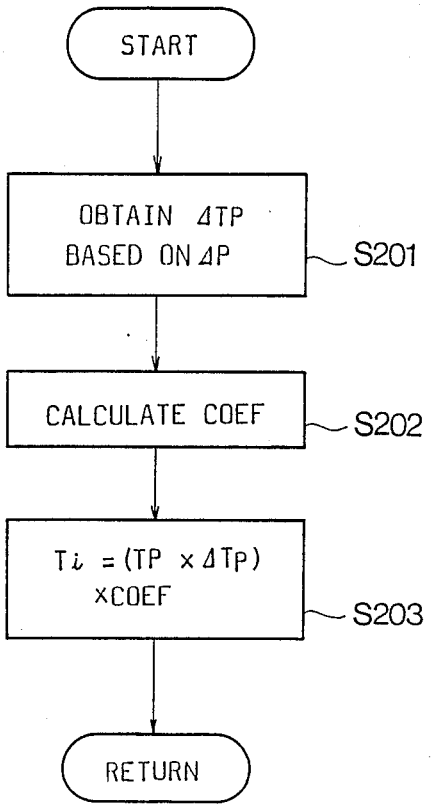
FIG. 6 is a flowchart showing a calculation routine for determining a fuel injection quantity.
Figure 7:
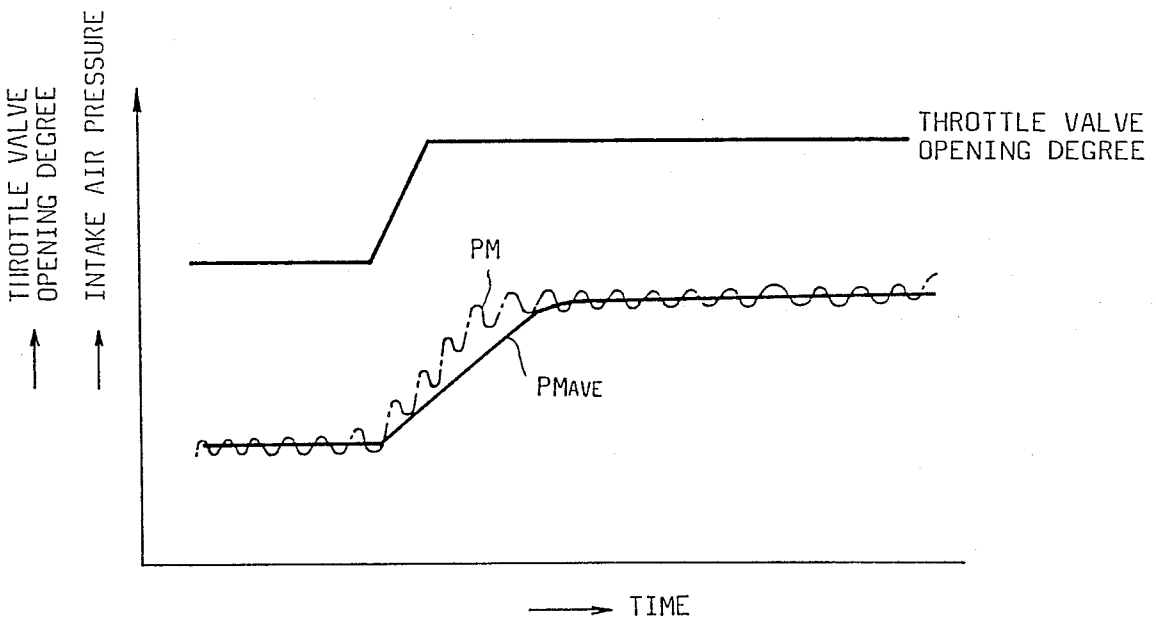
FIG. 7 is a graph showing a relationship between throttle opening degree and intake passage pressure.

FIG. 6 shows the flowchart for calculating the fuel injection quantity Ti. At a step S201, the correcting quantity $\Delta Tp$ is calculated based on the changing rate $\Delta P$. At a step S202, the miscellaneous coefficient COEF is calculated and at a step S203, the basic fuel injection quantity Tp is corrected with the correcting quantity $\Delta Tp$ and the correcting coefficient COEF.

In the present invention, since the basic injection quantity is corrected with the correcting quantity calculated based on intake passage pressure changing rate, proper quantity of fuel is injected without response delay at a transient state.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. A system for controlling fuel injection of an engine for a motor vehicle having an intake passage, a throttle valve provided in the intake passage, and a fuel injector for injecting fuel, the system comprising:

an engine speed sensor producing an engine speed signal dependent on speed of the engine;

a throttle position sensor producing a throttle position signal dependent on opening degree of the throttle valve;

a pressure sensor producing a pressure signal dependent on pressure in the intake passage;

first calculator means responsive to the engine speed signal and the pressure signal for producing a basic fuel injection quantity signal;

estimating means responsive to the engine speed signal and the throttle position signal for estimating pressure in the intake passage and for producing an estimated pressure signal;

second calculator means for calculating a changing rate of the estimated pressure signal;

means responsive to the changing rate of the estimated pressure signal for producing a correcting signal;

corrector means for correcting the basic fuel injection quantity signal with the correcting signal, so as to determine the quantity of fuel to be injected.

2. The system according to claim 1, wherein the engine speed sensor is a crank angle sensor.

3. The system according to claim 1, wherein the correcting signal is a coefficient.

4. The system according to claim 1, further comprising transient state determining means responsive to the changing rate of the estimated pressure signal for producing a transient signal when the changing rate exceeds a predetermined reference value, the correcting means being provided for correcting the basic fuel injection quantity signal in response to the transient signal.

* * * * *